United States Patent [19]

Iseki

[11] 4,224,715

[45] Sep. 30, 1980

[54] HINGE

[75] Inventor: Kazuo Iseki, Tokyo, Japan

[73] Assignee: Ohta Company Limited, Tokyo, Japan

[21] Appl. No.: 31,650

[22] Filed: Apr. 19, 1979

[30] Foreign Application Priority Data

Feb. 8, 1979 [JP] Japan ..... 54-1534154

[51] Int. Cl.[2] ..... E05D 5/06

[52] U.S. Cl. ..... 16/135

[58] Field of Search ..... 16/135, 137, 167

[56] References Cited

U.S. PATENT DOCUMENTS

| | | | |
|---|---|---|---|
| 1,429,527 | 9/1922 | Paul | 16/135 |
| 1,727,321 | 9/1921 | Arocha | 16/135 X |
| 2,818,146 | 12/1957 | Palmieri | 16/135 X |
| 3,120,024 | 2/1964 | Sherwood | 16/135 |

*Primary Examiner*—Andrew V. Kundrat

*Attorney, Agent, or Firm*—John C. Smith, Jr.

[57] ABSTRACT

A hinge having a hinge member mounted in an auxiliary hinge member made of a plastic, die casting or metal material in an overlapped relation thereto, with a decorative design provided on an exposed portion of the auxiliary hinge member.

5 Claims, 7 Drawing Figures

HINGE

BACKGROUND OF THE INVENTION

1. Field of the Invention

This invention relates to hinges and, more particularly, to door hinges having hinge members which are exposed when the hinges are mounted.

2. Description of the Prior Art

Hinges used for room doors or furniture doors include those, in which both hinge members 1 and 2 have bent pivotable portions 1*b* and 2*b* at some angles with respect to base portions 1*a* and 2*a* as shown in FIG. 1A, or those, in which a hinge member 1 is bent by a certain angle as shown in FIG. 1B, and these hinges are mounted, for instance, as in FIGS. 2 and 5, with the base portion 1*a* of the hinge member 1 exposed. Designated at 1*c* and 2*c* are hinge pin guide holes, at 3 hinge pin, at 4 a door, and at 5 a pillar.

There are proposals to impart such hinges with a function of automatically closing the door, for instance, as disclosed in U.S. Pat. No. 3,391,420 and Japanese Patent Publication No. 4365/72.

The above patents disclose decorative hinges comprising hinge members having various outer shapes and also provided various irregularities. However, the bending process of the bent portions of the pivotable portions 1*b* and 2*b* and the hinge pin guide holes 1*c* and 2*c* imposes limitations upon the decorative outer shape or pattern. Besides, it is not economical to produce a stamping mold or bending mold for each of a variety of shapes or patterns.

SUMMARY OF THE INVENTION

An object of the present invention is to provide a hinge, which overcome the drawbacks inherent in the prior art. In the hinge according to the present invention the hinge members are simple in form, and the hinge is provided with a separate auxiliary hinge member provided with a decorative design so that hinges having a variety of decorative designs may be readily and inexpensively manufactured with the combination of the hinge members and auxiliary hinge member.

DETAILED DESCRIPTION OF PREFERRED EMBODIMENTS

Figure 1A:
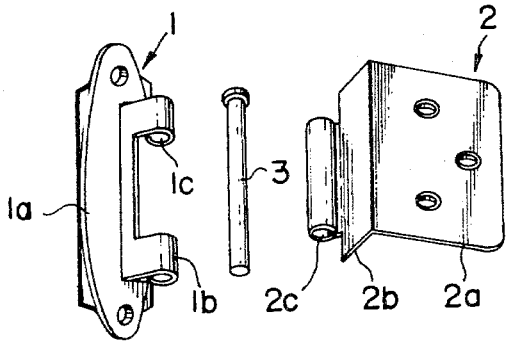
FIG. 1A PRIOR ART
FIGS. 1A and 1B are exploded perspective views showing prior-art hinges.
Figure 2:
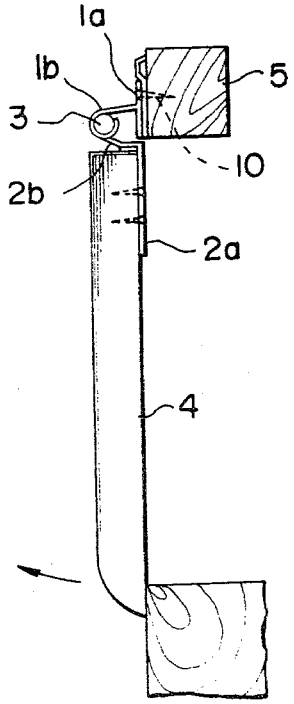
FIG. 2 shows a plan view of a set-up, in which a hinge embodying the invention is mounted.
Figure 1B:
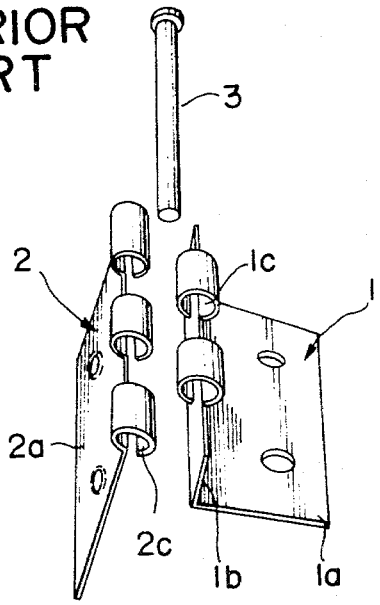
FIG. 1B PRIOR ART
Figure 3:
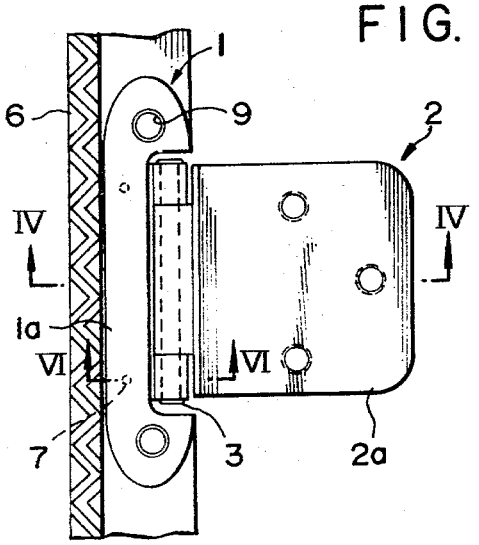
FIG. 3 shows an elevational view showing an embodiment of the hinge according to the invention.
Figure 5:
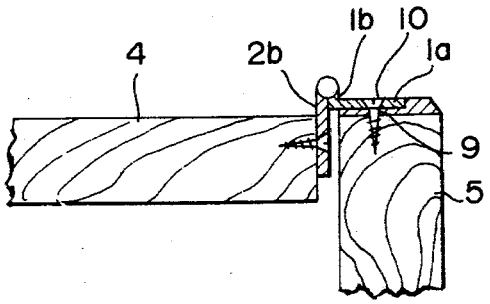
FIG. 5 is a sectional view showing another embodiment of the hinge according to the invention.
Figure 4:
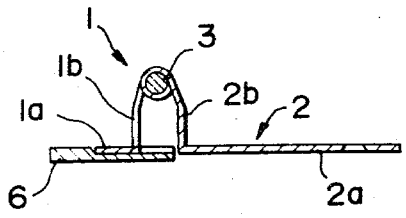
FIG. 4 is a section taken along line IV—IV in FIG. 3.
Figure 6:
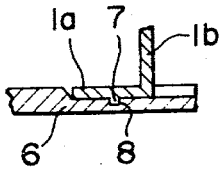
FIG. 6 is a section taken along line VI—VI in FIG. 3.

FIG. 3 is an elevational view of an embodiment of the invention using the hinge shown in FIG. 1A, and FIG. 4 is a section taken along IV—IV in FIG. 3. Designated at 6 in the drawings is an auxiliary hinge member, which may be a plastic molding or a die casting or may be stamped from a metal plate with a press. It is provided in its portion other than its base portion with a suitable design. For the positioning of the base portion 1*a* and auxiliary hinge member 6 with respect to each other, the base portion is provided on its one side with convexed portions 7 while providing the auxiliary hinge member on the corresponding side thereof with concave portion 8 so that these portions may engage one other when the base portion and auxiliary hinge member are overlapped over each other. Alternatively, the base portion and auxiliary hinge member may be overlapped by registering wood screw holes 9 formed in them. In their overlapped state, the base portion and auxiliary hinge member are mounted by screws 10 on a pillar or the like.

It is possible to provide the auxiliary hinge member with the convexed portions 7 and the base portion 1*a* with the recesses 8.

As has been shown, by providing the auxiliary hinge member 6 separately from the base portion 1*a* it is possible to readily obtain various shapes or patterns independently of the bending process of the hinge members. In addition, since the base portion 1*a* of the hinge member is simple in form, the manufacture is ready. Further, it is possible to use the auxiliary hinge member for positioning the hinge before mounting, so that the mounting can be facilitated.

I claim:

1. In a hinge in which at least one of its members has a bent pivotable portion with respect to a base portion, the improvement comprising an auxiliary hinge member larger than said base portion of said bent pivotable portion and arranged to be mounted between the surface of a pillar and said base portion of said bent pivotable portion in overlapped relation with said base portion of said bent pivotable portion, at least one portion of one of the mating surfaces of said base portion of said bent pivotable portion and of said auxiliary hinge member being convex and at least one portion of the other of the mating surfaces being concave for proper positioning of said base portion of said bent pivotable portion on said auxiliary hinge member.

2. The improvement according to claim 1, wherein a portion of said auxiliary hinge member not covered by said hinge member is provided with a decorative design.

3. The improvement according to claim 1, wherein said auxiliary hinge member is made of a plastic material.

4. The improvement according to claim 1, wherein said auxiliary hinge member is a die casting.

5. The improvement according to claim 1, wherein said auxiliary hinge member is made of a metal member.

* * * * *